US007051886B1

(12) United States Patent
Han

(10) Patent No.: US 7,051,886 B1
(45) Date of Patent: May 30, 2006

(54) SOLID SOAP WITH CONNECTING AND KEEPING MEANS

(76) Inventor: Moon-Key Han, Sinan Apt. 103-709, 384 Muk 1-dong, Jungrang-gu, Seoul (KR) 131-141

( * ) Notice: Subject to any disclaimer, the term of this patent is extended or adjusted under 35 U.S.C. 154(b) by 0 days.

(21) Appl. No.: 10/069,762

(22) PCT Filed: Sep. 1, 2000

(86) PCT No.: PCT/KR00/00993

§ 371 (c)(1),
(2), (4) Date: Feb. 28, 2002

(87) PCT Pub. No.: WO01/16282

PCT Pub. Date: Mar. 8, 2001

(30) Foreign Application Priority Data

Sep. 1, 1999 (KR) ..... 1999/18489

(51) Int. Cl.
*A47F 5/08* (2006.01)

(52) U.S. Cl. ..... 211/113; 211/85.12; 211/118; 211/119.009

(58) Field of Classification Search ..... 211/119.009, 211/113, 117, 118, 13.1, 85.12, 49.1, 85.29, 211/85.31; 248/684, 686, 690, 610, 309.1, 248/309.2, 317, 320, 322, 323, 339; 206/77.1; 403/76, 90, 122, 165, 21, 22, 48, 77, 109.4, 403/307; 510/447–450
See application file for complete search history.

(56) References Cited

U.S. PATENT DOCUMENTS 658,991 A * 10/1900 Langguth ..... 248/686
706,992 A * 8/1902 Neamann ..... 248/317
849,978 A * 4/1907 Cox ..... 248/686
981,270 A * 1/1911 Hurff ..... 211/125
984,992 A * 2/1911 Allsup ..... 211/125
1,318,567 A * 10/1919 Key ..... 248/693
1,325,290 A * 12/1919 Holmes ..... 211/125
1,342,844 A * 6/1920 Davis ..... 248/686
1,831,509 A * 11/1931 Rinehardt ..... 211/65
2,679,709 A * 6/1954 Du Bois ..... 248/579
2,934,852 A * 5/1960 Heberling ..... 248/690
2,988,842 A * 6/1961 Seufert et al. ..... 248/686
3,054,321 A * 9/1962 Macchia ..... 411/403
3,160,523 A * 12/1964 Hull ..... 510/143
3,212,647 A * 10/1965 Meyer et al. ..... 211/118
3,709,373 A * 1/1973 Aguilar ..... 211/113
3,850,010 A * 11/1974 Noto ..... 63/1.16
3,969,026 A * 7/1976 Johnson ..... 401/37
3,999,821 A * 12/1976 Moody et al. ..... 312/236
4,034,865 A * 7/1977 Batts et al. ..... 211/118

(Continued)

FOREIGN PATENT DOCUMENTS

JP 54-050051 U 4/1979

(Continued)

*Primary Examiner*—Jennifer E. Novosad
(74) *Attorney, Agent, or Firm*—Robert E. Bushnell, Esq.

(57) ABSTRACT

By use of a connecting and keeping unit, solid soap is easily kept and used by connecting, in one line, several kinds of solid soap, each different in usage. The unit is constructed by burying a support body equipped with a connecting unit for connecting several cakes of solid soap into a soap body. As a result, a cake of desired soap can be selected from a consecutive connection of several bars of solid soap in a user's bathroom since each bar of soap is supported by the support body and the connecting unit of the support body is also provided at both ends of each bar of soap.

8 Claims, 4 Drawing Sheets

U.S. PATENT DOCUMENTS 5,074,699 A * 12/1991 Blaisdell et al. ..... 403/122
5,285,908 A * 2/1994 Rogers ..... 211/118
5,351,346 A * 10/1994 Hodges, Jr. ..... 4/605
5,678,733 A * 10/1997 Ong ..... 222/108
6,000,591 A * 12/1999 Alexander ..... 224/257
6,123,238 A * 9/2000 Dumplet ..... 223/1
6,257,421 B1 * 7/2001 Outten ..... 211/40
6,612,530 B1 * 9/2003 Kwak et al. ..... 248/317
6,629,799 B1 * 10/2003 Flores, Jr. ..... 401/270
2002/0150418 A1 * 10/2002 Sorrell ..... 401/205

FOREIGN PATENT DOCUMENTS

JP 57-069848 U 4/1982
JP 60-181352 U 12/1985
JP 8-52085 * 8/1996
KR 90-003825 Y 5/1990

* cited by examiner

SOLID SOAP WITH CONNECTING AND KEEPING MEANS

TECHNICAL FIELD

The present invention relates to a connecting and keeping unit for solid soap, which is capable of easily connecting with and utilizing several kinds of solid soap mutually different in their usage. More particularly, the invention relates to a connecting and keeping unit, in which cleanser and perfume etc. can be kept with the solid soap and loss of the solid soap can be prevented.

BACKGROUND ART

In conventional use of solid soap, the soap is generally not dried, and this is especially true of the bottom part of the soap since the wet solid soap is kept inside a soap case. There is, therefore, a problem in that the solid soap partially crumbles and is lost since the soap absorbs moisture as it is coming into contact with the soap case. Thus, the surface of the soap crumbles. Furthermore, there is an inconvenience in keeping and managing several kinds of solid soap.

DISCLOSURE OF THE INVENTION

Accordingly, the present invention is directed to a connecting and keeping unit for solid soap that substantially obviates one or more of the limitations and disadvantages of the related art.

A primary object of the present invention is to provide solid soap with a connecting and keeping unit, by means of which it is easy to keep solid soap, and which selectively contains several kinds of solid soap, while maintaining the solid soap in dry state. In addition, the soap is kept together with cleanser and perfume for use in a bathroom.

BRIEF DESCRIPTION OF THE DRAWINGS

The above and other objects and features of the instant invention will become apparent from the following description of preferred embodiments taken in conjunction with the accompanying drawings, in which.

BEST MODE FOR CARRYING OUT THE INVENTION

Reference will now be made in detail to the preferred embodiments of the present invention, examples of which are illustrated in the accompanying drawings.

Figure 1:
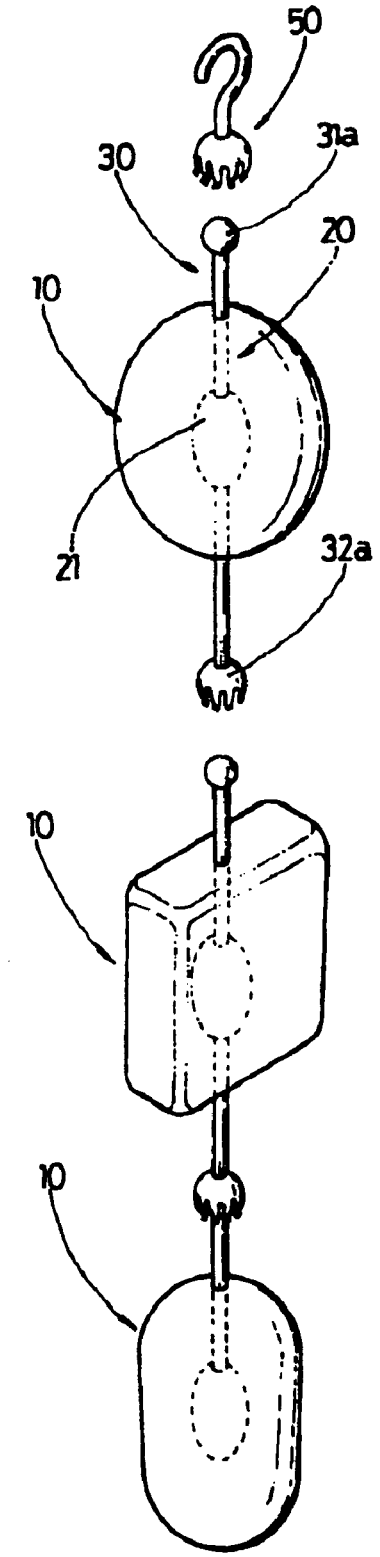
FIG. 1 is an exemplary perspective view of one embodiment of the present invention.
Figure 2:
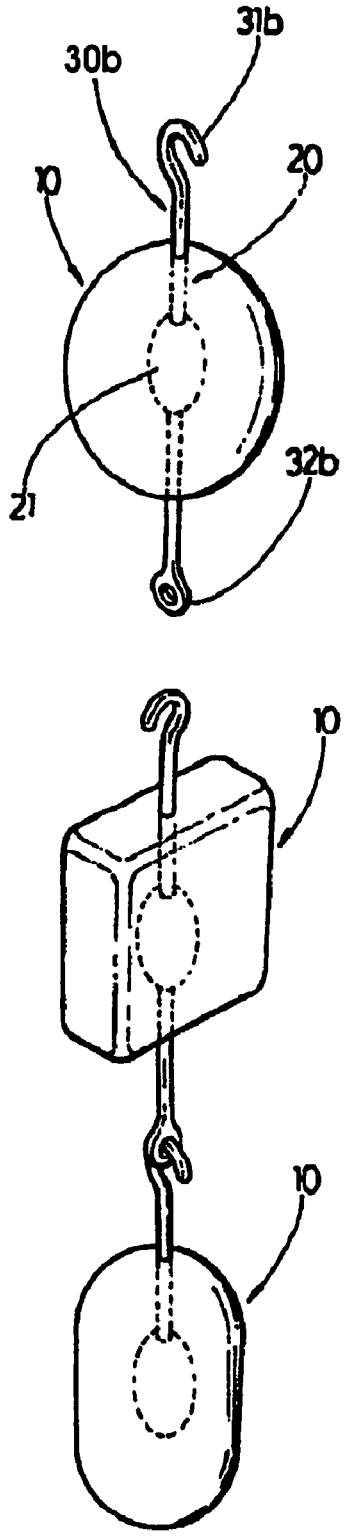
FIG. 2 is an exemplary perspective view of another embodiment of the present invention.
Figure 3:
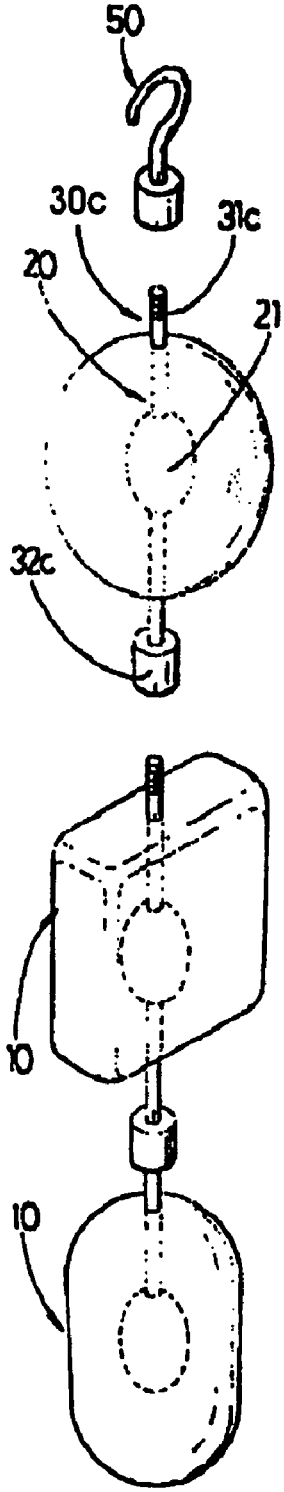
FIG. 3 is an exemplary perspective view of a further embodiment of the present invention.
Figure 4:
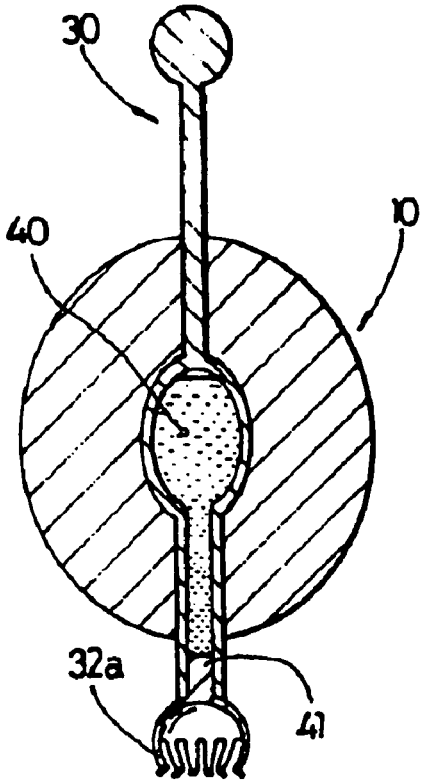
FIG. 4. is an exemplary sectional view of an embodiment of a support body in accordance with the present invention.
Figure 5:
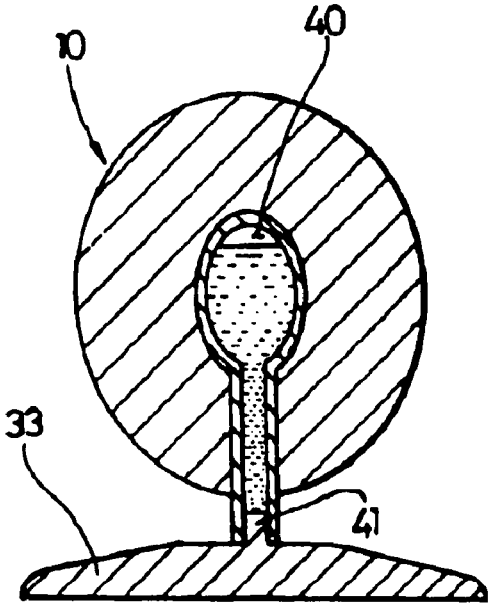
FIG. 5 is an exemplary sectional view of another embodiment of the support body of the present invention.

In accordance with the present invention, FIG. 1 is a perspective view showing the construction of the invention as an example, and FIGS. 2 and 3 are exemplary perspective views of another embodiment of a connecting unit, while FIG. 4. is an exemplary sectional view of an embodiment of a support body, and FIG. 5 is an exemplary sectional view of another embodiment of the support body. As shown in the drawings, a support body 20 having a main portion 21 for supporting soap is partially buried inside a soap body 10, and both end parts of the support body 20 are exposed outside the soap body 10 and are provided as a connecting unit 30 for connecting the soap thereto. As shown in FIG. 1, in the connecting unit 30, one end of the support body 20 has an insertion shaft 31*a* which is enlarged at an end part thereof, and another end of the support body 20 has a socket type clip 32*a* which has an expanded opening aperture at an end part thereof. As a result, several cakes of soap can be connected with one another consecutively. In FIG. 2, which is an exemplary diagram of another connecting unit 30*b*, one end of the support body 20 has a hook part 31*b* and another end thereof has a ring type insertion part 32*b* into which the hook part 31*b* may be inserted and hooked, so as to thereby provide a connection for the soap. In FIG. 3, which is an exemplary diagram of another connecting unit 30*c*, one end of the support body 20 has a bolt part 31*c* and another end has a nut part 32*c*, so as to provide a connection for several cakes of soap. In FIG. 4, which is an exemplary diagram of the support body 20, there is formed a receptacle 40 having one side of the connecting unit 30 provided as a stopper 41 to open and close the receptacle 40, the receptacle 40 being provided with cleanser or perfume which can be used with the soap. The stopper 41 of the receptacle 40 is formed in the support body 20 and is enlarged as shown in FIG. 5, so that the connecting unit 30 can be used as a sitting support die 33.

INDUSTRIAL APPLICABILITY

As previously mentioned, in accordance with the present invention, the soap body 10 is supported by the support body 20 and the connecting unit 30, 30*b* or 30*c* is provided at both ends of the support body 20. Accordingly, a user can selectively use desired soap chosen from a consecutive connection of several bars of solid soap. There is also a convenience in that a cake of solid soap can be mounted or displayed together with perfume or cleanser or other necessities for use in a bathroom as a result of provision of the inventive receptacle formed in the support body 20. In addition, crumbling and loss of the soap can be prevented by use of the hook 50 or the sitting support die 33.

Although the invention has been shown and described with respect to the preferred embodiments, it will be understood by those skilled in the art that various changes and modifications may be made without departing from the spirit and scope of the invention as defined in the following claims.

What is claimed is:

1. A unit for interconnecting a bar of soap and other items, comprising:

a support body buried in the bar of soap;

first connecting means extending out of the bar of soap from a first end of the bar of soap for connecting the bar of soap to a hanging device from which the bar of soap hangs; and second connecting means extending out of the bar of soap from a second end of the bar of soap for connecting the bar of soap to one of the other items;

wherein said second connecting means comprises a shaft having a socket type clip formed on an end of said shaft for connection to an end of an insertion shaft extending from said one of the other items.

2. The unit of claim 1, wherein said first connecting means comprises a shaft having a hook disposed on an end of said shaft for connection to the hanging device.

3. The unit of claim 1, wherein said first connecting means comprises a shaft having a bolt formed on an end of said shaft for connection to a nut part formed on an end of the hanging device.

4. A unit for interconnecting a bar of soap and other items, comprising:

a support body buried in the bar of soap;

first connecting means extending out of the bar of soap from a first end of the bar of soap for connecting the bar of soap to a hanging device from which the bar of soap hangs; and second connecting means extending out of the bar of soap from a second end of the bar of soap for connecting the bar of soap to one of the other items;

wherein said first connecting means comprises an insertion shaft which is enlarged at its end for insertion into a socket type clip provided at an end of the hanging device.

5. The unit of claim 4, wherein said second connecting means comprises a shaft having a socket type clip formed on an end of said shaft for connection to an enlarged end of an insertion shaft extending from one of the other items.

6. A unit for interconnecting a bar of soap and other items, comprising:

a support body buried in the bar of soap;

first connecting means extending out of the bar of soap from a first end of the bar of soap for connecting the bar of soap to a hanging device from which the bar of soap hangs; and second connecting means extending out of the bar of soap from a second end of the bar of soap for connecting the bar of soap to one of the other items;

wherein said second connecting means comprises a shaft having a ring formed at an end of said shaft for connection to a hook formed on an end of a further shaft extending from said one of the other items.

7. A unit for interconnecting a bar of soap and other items, comprising:

a support body buried in the bar of soap;

first connecting means extending out of the bar of soap from a first end of the bar of soap for connecting the bar of soap to a hanging device from which the bar of soap hangs; and second connecting means extending out of the bar of soap from a second end of the bar of soap for connecting the bar of soap to one of the other items;

wherein said second connecting means comprises a shaft having a nut part formed on an end of said shaft for connection to a bolt formed on an end of a further shaft extending from said one of the other items.

8. The unit of claim 7, wherein said first connecting means comprises a shaft having a bolt formed on an end of said shaft for connection to a nut part formed on an end of the hanging device.

* * * * *